US005507061A

United States Patent [19]

Miyazaki

[11] Patent Number: 5,507,061

[45] Date of Patent: Apr. 16, 1996

[54] ROTARY BRUSH FLOOR POLISHER

[75] Inventor: Yoshiro Miyazaki, Omiya, Japan

[73] Assignee: Nobuyoshi Kumaki, Saitama, Japan

[21] Appl. No.: 315,661

[22] Filed: Sep. 30, 1994

Related U.S. Application Data

[63] Continuation of Ser. No. 171,846, Dec. 22, 1993, abandoned, which is a continuation of Ser. No. 728,057, Jul. 9, 1991, abandoned, which is a continuation of Ser. No. 492,162, Mar. 13, 1990, abandoned.

[30] Foreign Application Priority Data

Apr. 5, 1989 [JP] Japan ..... 1-86088

[51] Int. Cl.[6] ..... A47L 11/14; A47L 11/162

[52] U.S. Cl. ..... 15/98; 15/49.1; 451/353

[58] Field of Search ..... 15/491, 50.1, 50.2, 15/52.2, 98, 385, 412, 327.6; 51/170 T, 177; 267/166, 64.27, 177, 206, 140.1 R, 141.3, 195, 35, 136, 152, 153, 292; 248/569, 604, 630, 636, 562, 609; 451/353, 359

[56] References Cited

U.S. PATENT DOCUMENTS

| | | | |
|---|---|---|---|
| 889,309 | 6/1908 | Jenkins, Jr. | 15/49.1 |
| 1,643,882 | 9/1927 | Faiver | 51/170 T |
| 2,044,649 | 6/1936 | Swennes et al. | 267/292 X |
| 2,101,895 | 12/1937 | Boulton | 15/49.1 X |
| 2,250,177 | 7/1941 | Boccasile | 15/385 |
| 2,967,315 | 1/1961 | Helbig et al. | 15/49.1 |
| 3,007,692 | 11/1961 | Kniffen, Jr. | 267/153 |
| 3,101,889 | 8/1963 | Tatge | 15/327.6 X |
| 3,107,752 | 10/1963 | McLean | 248/562 X |
| 3,381,326 | 5/1968 | Dolan et al. | 15/50.1 X |
| 3,550,179 | 12/1970 | Brown | 15/98 X |
| 3,731,465 | 5/1973 | Ohira et al. | 15/327.6 X |
| 3,949,975 | 4/1976 | Miers et al. | 267/136 |
| 4,271,557 | 6/1981 | Caron | 15/49.1 X |
| 4,319,434 | 3/1982 | Brejcha | 15/49.1 X |
| 4,701,976 | 10/1987 | Palmer et al. | 15/98 X |
| 4,806,437 | 2/1989 | Yokoi et al. | 267/153 X |
| 4,845,798 | 7/1989 | Genovese | 15/98 |
| 4,866,804 | 9/1989 | Masbruch et al. | 15/49.1 |
| 4,881,288 | 11/1989 | May et al. | 15/98 |
| 4,899,997 | 2/1990 | Thorn | 267/35 X |
| 4,957,279 | 9/1990 | Thorn | 248/562 X |
| 4,964,623 | 10/1990 | Thorn | 248/562 X |

FOREIGN PATENT DOCUMENTS

| | | | |
|---|---|---|---|
| 128277 | 12/1984 | European Pat. Off. | 15/98 |
| 0880472 | 6/1953 | Germany | 15/49.1 |
| 3500775 | 1/1986 | Germany | 248/562 |
| 0003372 | 1/1979 | Japan | 15/49.1 |
| 104171 | 7/1983 | Japan . | |
| 93642 | 4/1989 | Japan | 248/562 |
| 6515728 | 6/1966 | Netherlands | 15/412 |
| 0441262 | 1/1936 | United Kingdom | 15/412 |

*Primary Examiner*—Edward L. Roberts, Jr.
*Attorney, Agent, or Firm*—Armstrong, Westerman, Hattori, McCleland & Naughton

[57] ABSTRACT

A rotary brush floor polisher is provided with an upper and a lower disk member movably connected with each other through a shock absorbing member interposed therebetween, on which lower disk member is fixedly mounted a polishing brush or pad which is rotatably driven by an electric motor to glide over a floor to polish and clean the same. The polisher is characterized by the shock absorbing member each of which is interposed: between the upper and the lower disk member; and between the electric motor and a platform on which the motor is mounted. The shock absorbing member has a simple and compact construction which: realizes reduction in size of the polisher; reduces vibrations and noise in operation; and eliminates a fear that the operator's fingers and like objects are sandwiched between the upper and the lower disk member by mistake in operation to ensure a safety operation of the polisher.

14 Claims, 11 Drawing Sheets

ROTARY BRUSH FLOOR POLISHER

This application is a continuation of application Ser. No. 08/171,846 filed Dec. 22, 1993 now abandoned, which is a continuation of application Ser. No. 07/728,057 filed Jul. 9, 1991, now abandoned, which is a continuation of application Ser. No. 07/492,162, filed Mar. 13, 1990, now abandoned.

BACKGROUND OF THE INVENTION

1. Field of the Invention

The present invention relates to a rotary brush floor polisher, and more particularly to a rotary brush floor polisher provided with a disk-like rotary brush or pad rotatably driven by an electric motor, the polisher being adapted to glide smoothly over a floor to polish and clean the floor by means of the brush or pad.

2. Description of the Prior Art

Heretofore, it has been known to provide a rotary brush floor polisher of the type shown in Japanese Utility Model Laid-Open No. 58-104171 having a construction as shown in FIGS. 11 and 12 in which: an upper disk member 1 is oppositely disposed from a lower disk member 2; a plurality of mounting bolts 3 are vertically fixed to a peripheral portion of an upper surface of the lower disk member 2 at equal angular intervals; a plurality of bolt holes 4 are vertically formed in a peripheral portion of the upper disk member 1 at positions corresponding to those of the mounting bolts 3 of the lower disk member 2, each of which bolts holes 4 is slightly larger in diameter than the mounting bolts 3 and receives a bushing 5 therein as shown in FIG. 12; and each of the mounting bolts 3 of the lower disk member 2 passes upward through a coil spring 7 having interposed between the upper disk member 1 and the lower disk member 2 and also passes through each of the bushings 5 having been mounted in the bolt holes 4 of the upper disk member 1, and is threadably connected with a nut 6 so that the upper disk member 1 is vertically movably connected with the lower disk member 2.

The above conventional rotary brush floor polisher is provided with a shock absorbing means for reducing vibrations of the rotary brush. However, the conventional floor polisher is not provided with a shock absorbing means for reducing vibrations of the electric motor, so that vibrations of the motor and the upper disk member 1 are directly transmitted to the hands of an operator holding the floor polisher through an operating handle of the polisher. In addition, the conventional floor polisher is too noisy in operation.

In the conventional floor polisher having the above construction, there is a fear that the mounting bolts 3 scrub the inner surfaces of the bushings 5, or a fear that the mounting bolts 3 excessively tilt in the bushings 5 to jam the coil springs 7 between the upper disk member 1 and the lower disk member 2, whereby the coil springs 7 are prevented from absorbing shocks produced in operation of the floor polisher.

In addition, when the mounting bolts 3 scrub the inner surfaces of the bushings 5 or excessively tilt in the bushings 5, a considerable noise is produced in operation of the floor polisher.

Further, in case that the floor polisher vibrates with large amplitude in operation, an upper end portion of each of the mounting bolts 3 excessively extends upward from the upper surface of the upper disk member 1 to make it impossible to realize a substantial reduction in size of the polisher.

Furthermore, in the conventional floor polisher having the above construction, there is a fear that the operator's fingers and like objects are sandwiched between the nuts 6 and the upper surface of the upper disk member 1 when the coil springs 7 are compressed in operation.

SUMMARY OF THE INVENTION

It is an object of the present invention to provide a rotary brush floor polisher which resolves the above problems inherent in the conventional floor polisher.

According to the present invention, there is provided:

In a rotary brush floor polisher comprising:

a platform provided with an operating handle;

an electric motor which is fixedly mounted on the platform while provided with a rotary shaft extending downward from a lower surface of the platform;

an upper disk member which is disposed under the platform while fixedly mounted on the rotary shaft of the electric motor under the platform;

a lower disk member which is disposed under the upper disk member while mounted on the upper disk member so as to be movable in a vertical and a horizontal direction relative to the upper disk member; and a brush or pad fixedly mounted on a lower surface of the lower disk member;

the improvement wherein:

each of shock absorbing means is interposed: between the upper disk member and the lower disk member; and between the electric motor and the platform.

In the rotary brush floor polisher of the present invention having the above construction, the shock absorbing means may be constructed of a pair of mounting bolts and a shock-absorbing coil spring which has its opposite axial end portions closely wound and its central portion coarsely wound. One of the mounting bolts is so mounted in a through-hole of the upper disk member as to have its threaded portion extend downward from a lower surface of the upper disk member. On the other hand, the other of the mounting bolts is so mounted in a through-hole of the lower disk member as to have its threaded portion extend upward from an upper surface of the lower disk member, while aligned with the one of the mounting bolts in position so as to be oppositely disposed from the same. The shock-absorbing coil spring is so mounted on the threaded portions of the thus aligned mounting bolts as to have its opposite axial end portions threadably connected with the threaded portions of the mounting bolts, so that the upper and lower disk member are movably connected with each other by means of the mounting bolts and the shock-absorbing coil spring.

In addition, the shock absorbing means may be constructed of a solid cylindrical rubber vibration insulator and a pair of mounting bolts head portions of which are embedded in opposite axial end portions of the cylindrical rubber vibration insulator. Each of threaded portions of the mounting bolts having their head portions embedded in the insulator passes through a through-hole of each of the upper and the lower disk member and is threadably connected with a nut, so that the upper and the lower disk member are movably connected with each other by means of the shock absorbing means. Further, the shock absorbing means may be constructed of: an annular rubber vibration insulator; a pair of annular mounting plates which are fixedly mounted on an upper and a lower surface of the insulator through baking process; and a plurality of bolts and nuts.

Furthermore, the shock absorbing means may be constructed of: a sleeve-like rubber vibration insulator on an inner and an outer peripheral surface of which an inner and an outer metallic mounting sleeve are fixedly mounted through baking process, respectively; and a mounting bolt passing through the insulator. In assembling, the outer metallic mounting sleeve fixedly mounted on the outer peripheral surface of the insulator is fixedly mounted in a through-hole of the lower disk member. On the other hand, a threaded portion of the mounting bolt passes through the inner metallic mounting sleeve upward so as to be threadably connected with a threaded hole of the upper disk member, so that the upper disk member is movably connected with the lower disk member through the shock absorbing means.

In addition, the shock absorbing means may be constructed of: a bag filled with a suitable fluid such as gases and liquids, which fluid may be replaced with elastic porous materials. In assembling, the bag is sandwiched: between the upper and the lower disk member; and between the electric motor and the platform.

DESCRIPTION OF THE PREFERRED EMBODIMENTS

Figure 1:
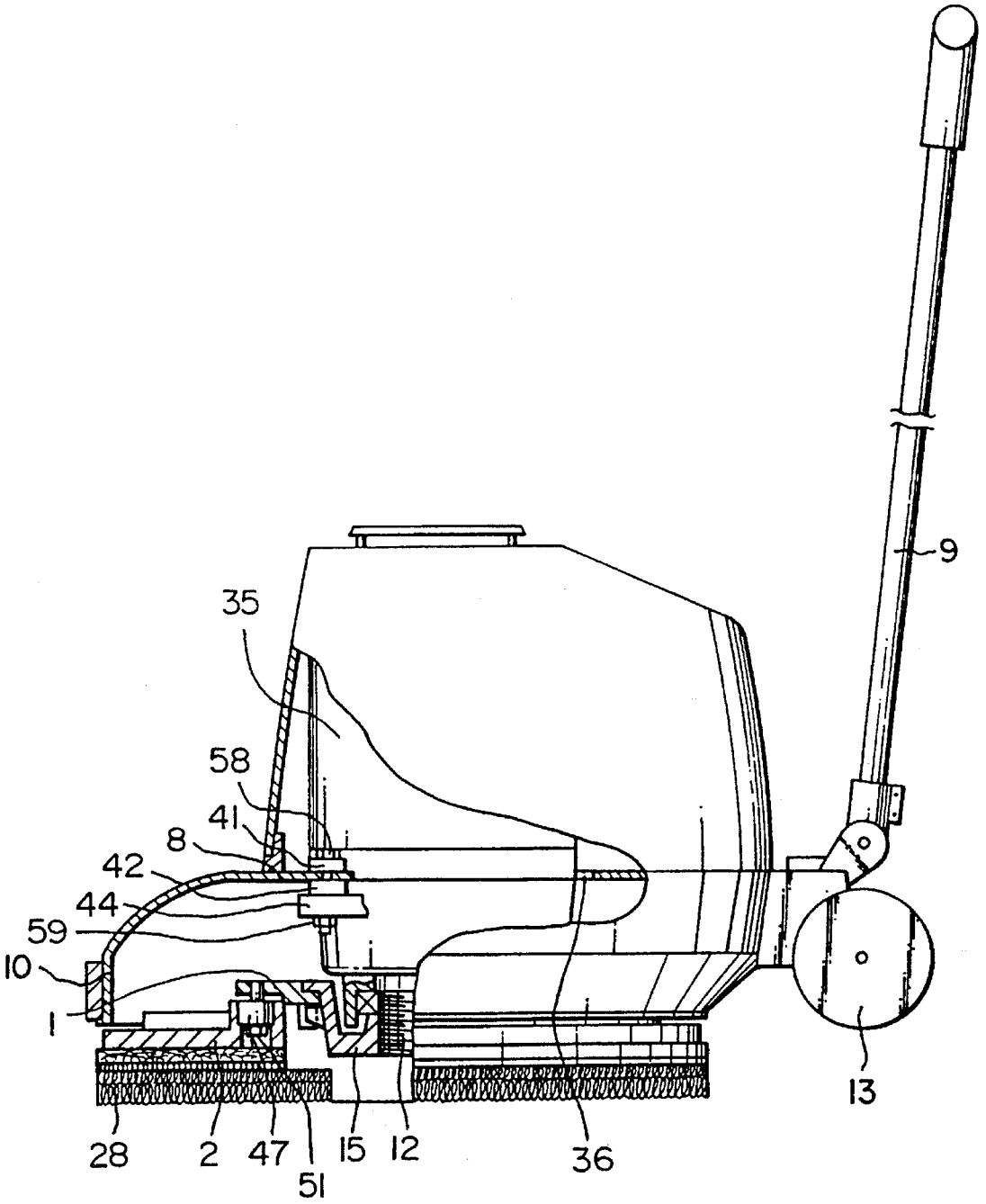
FIG. 1 is a partially broken side view of the rotary brush floor polisher employing a first embodiment of the shock absorbing means of the present invention.

Referring now to the drawings, wherein like reference numerals designate like parts. FIGS. 1 to 10 illustrate embodiments of the rotary brush floor polisher of the present invention.

Figure 2:
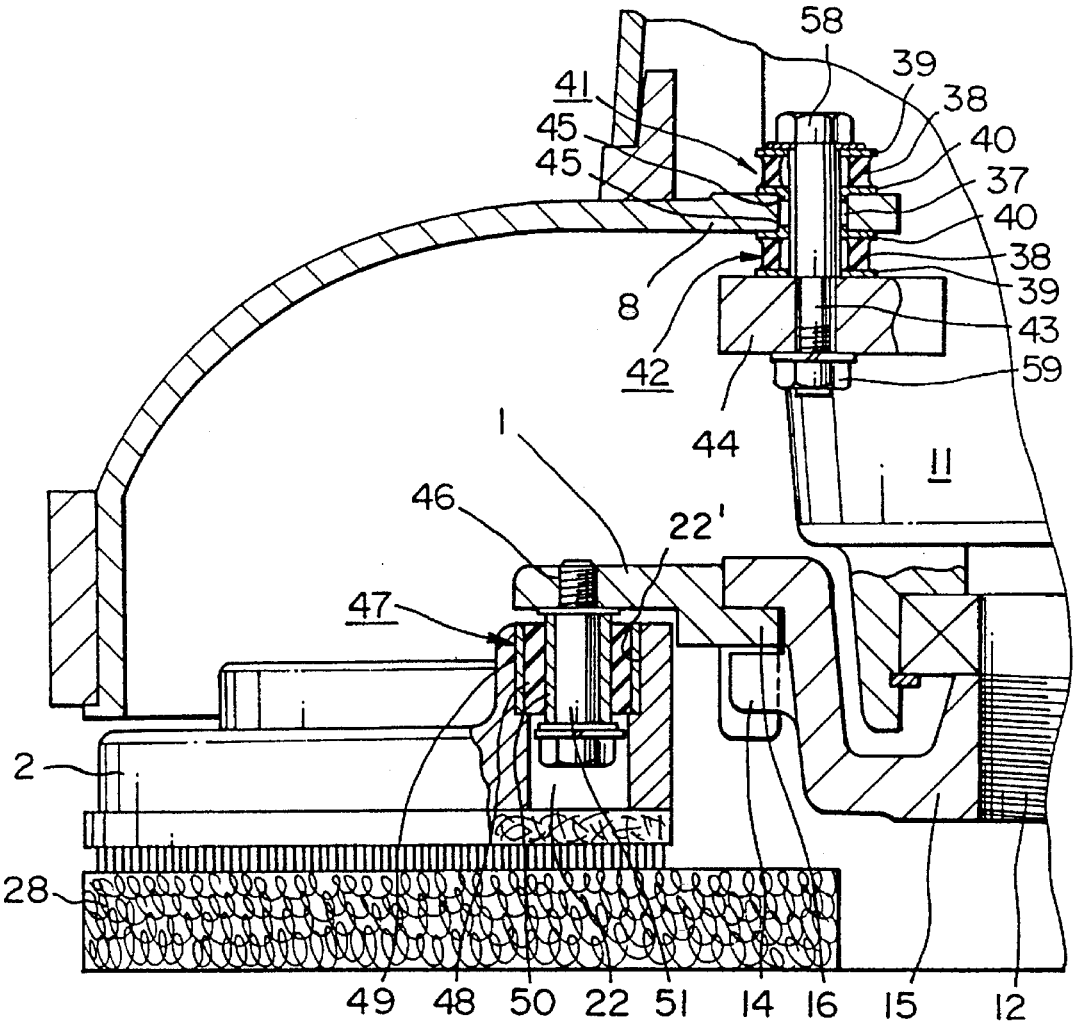
FIG. 2 is an enlarged side view of an essential part of the rotary brush floor polisher of the first embodiment of the present invention shown in FIG. 1.

As shown in FIGS. 1 and 2, a rotary brush floor polisher of the present invention is provided with a platform 8 on which an operating handle 9 is mounted. A skirt 10 is fixedly mounted on an outer peripheral portion of the platform 8 so as to extend downward, whereby the platform 8 and the skirt 10 form a housing for covering all rotating parts of the rotary brush floor polisher of the present invention except a part of a rotary brush unit of the polisher. As shown in FIG. 1, a vertical-shaft type electric motor 11 is fixedly mounted on the platform 8, a vertical rotary shaft 12 of which motor 11 extends downward to pass through the platform 8.

A wheel 13 is rotatably mounted on the platform 8 in a position under the operating handle 9.

A boss member 15 is provided with a bayonet socket portion 14 in its outer peripheral portion, while fixedly mounted on a lower end portion of the vertical rotary shaft 12 of the electric motor 11.

An annular upper disk member 1 is provided with a bayonet plug portion 16 in its inner peripheral portion.

An annular lower disk member 2 is provided with a plurality of vertical through-holes 22' in each of which a sleeve-like shock absorbing member 47 is fixedly mounted. The shock absorbing member 47 is constructed of: a sleeve-like rubber vibration insulator 48; an outer mounting sleeve 49 which is fixed to an outer peripheral surface of the rubber vibration insulator 48 through a baking process; and an inner mounting sleeve 50 which is fixed to an inner peripheral surface of the insulator 48 through a baking process, the inner mounting sleeve 50 being longer than the insulator 48.

As is clear from FIG. 2, the annular lower disk member 2 is larger in diameter than the annular upper disk member 1, while provided with a boss portion 17.

On the other hand, the upper disk member 1 is provided with a plurality of threaded holes or bolt holes 46 formed in an outer peripheral portion of the upper disk member 1 at equal angular intervals. A plurality of bolt holes 22' are formed in an inner peripheral portion or boss portion 17 of the lower disk member 2 at equal angular intervals so as to be aligned with the bolt holes 46 of the upper disk member 1. Each of the bolt holes 22' of the lower disk member 2 is provided with an upper large-diameter hole portion and a lower small-diameter portion 22 so that a shoulder portion 20 is formed in a substantially central portion of each of the bolt holes 22'.

In the lower small-diameter portion 22 of each of the bolt holes 22' is received a head portion of a hanging bolt 51 as shown in FIG. 2. On the other hand, in the upper large-diameter portion of each of the bolt holes 22' is fixedly mounted the sleeve-like rubber vibration insulator 47.

In assembling, as shown in FIG. 2, the hanging bolt 51 is inserted into each of the bolt holes 22' of the lower disk member 2 to pass through each of the rubber vibration insulators 47 so that a threaded portion of the hanging bolt 51 is threadably connected with each of the bolt holes 46 of the upper disk member 1, whereby the lower disk member 2 is movably connected with the upper disk member 1 through the rubber vibration insulators 47 and the hanging bolts 51.

As is clear from FIGS. 1 and 2, the platform 8 is provided with a central large-diameter hole 36 in which is fixedly mounted the electric motor 11. The platform 8 is provided with a plurality of bolt holes 37 in a portion adjacent to the central large-diameter hole 36 at equal angular intervals.

As shown in FIG. 2, upper and lower annular shock absorbing members 41 and 42 are disposed on an upper and a lower surface of the platform 8 so as to be aligned with each of the bolt holes 37, respectively. As a result, each of the bolt holes 37 is sandwiched between the annular shock absorbing members 41 and 42 each of which is constructed of: an annular rubber vibration insulator 38; and annular mounting plates 39 and 40 fixed to opposite axial end surfaces of the insulator 38. A lower surface of the mounting plates 39 of the lower shock absorbing member 42 abuts on an upper surface of a motor mounting bracket 44 formed in a lower portion of the electric motor 11, which lower portion of the motor 11 passes through the central large-diameter hole 36 of the platform 8 to extend downward from the platform 8. In assembling, a threaded portion of a bolt 58 passes through the upper shock absorbing member 41, bolt hole 37 of the platform 8, lower shock absorbing member 42 and the motor mounting bracket 44 of the motor 11 so as to be threadably connected with a nut 59, whereby the electric motor 11 is movably mounted on the platform 8 through the shock absorbing members 41, 42 and the bolts 58 and the nuts 59. Incidentally, as is clear from FIG. 2, the mounting plate 40 of each of the shock absorbing members 41, 42 is provided with an axial flange portion 45 which extends outward so as to be received in the bolt hole 37 of the platform 8. Consequently, each of the shock absorbing members 41, 42 is prevented from dropping out of the bolt hole 37 of the platform 8 in operation by means of these axial flange portions 45 of the mounting plates 40 fixed to the axial ends of the shock absorbing members 41, 42. The axial flange portions 45 of the shock absorbing members 41, 42 also serve to hold the bolt 58 in a predetermined position.

In the rotary brush floor polisher employing the first embodiment 41, 42 of the shock absorbing means of the present invention shown in FIGS. 1 and 2, vibrations produced: between the upper disk member 1 and the lower disk member 2; and between the electric motor 11 and the platform 8 are effectively reduced. As a result, in operation of the rotary brush floor polisher of the present invention, noise is considerably reduced, and it is possible to substantially prevent the operating handle 9 from being vibrated, which improves the floor polisher in operability. Since the rotary brush floor polisher of the present invention has the above construction, it is possible for the polisher to realize reduction in size and to eliminate a fear that the operator's fingers and like objects are sandwiched between the upper disk member 1 and the lower disk member 2 as is in the conventional polisher.

Figure 3:
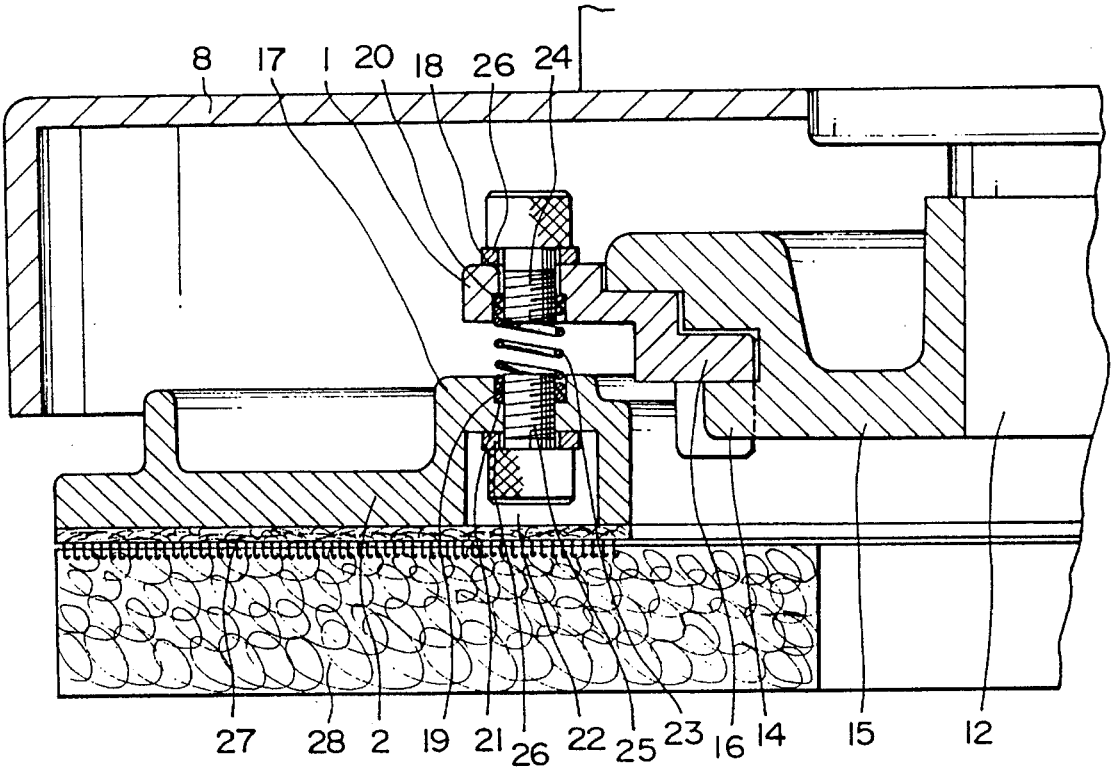
FIG. 3 is an enlarged side view of an essential part of the rotary brush floor polisher employing a second embodiment of the shock absorbing means of the present invention.
Figure 4:
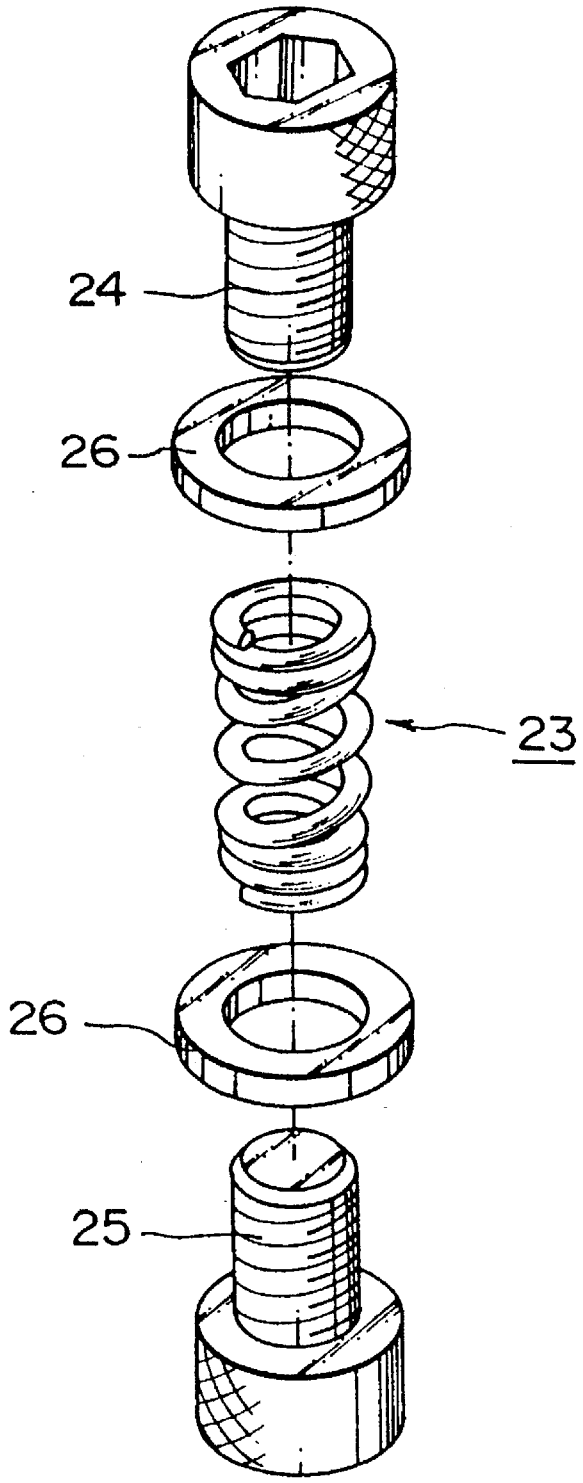
FIG. 4 is an exploded view of the second embodiment of the shock absorbing means employed in the rotary brush floor polisher of the present invention shown in FIG. 3.

FIGS. 3 and 4 show a second embodiment of the shock absorbing means employed in the rotary brush floor polisher of the present invention. As shown in FIG. 3, the second embodiment of the shock absorbing means is interposed between the upper disk member 1 and the lower disk member 2.

As shown in FIG. 3, twelve bolt holes 18 are formed in an outer peripheral portion of the upper disk member 1 at equal angular intervals. In positions corresponding to those of the bolt holes 18 of the upper disk member 1, twelve bolt holes 19 are also formed in an inner peripheral portion or boss portion 17 of the lower disk member 2 at equal angular intervals so as to be aligned with the bolt holes 18 of the upper disk member 1. Each of the bolt holes 18 of the upper disk member 1 is provided with: an upper small-diameter threaded portion; a central shoulder portion 20; and a lower large-diameter portion. On the other hand, each of the bolt holes 19 of the lower disk member 2 is provided with: an upper large-diameter portion; a central shoulder portion 21; and a lower small-diameter threaded portion. Twelve concave portions 22 are so formed in the boss portion 17 of the lower disk member 2 as to be aligned with the bolt holes 19 thereof, and receive head portions of lower mounting bolts 25 as shown in FIG. 3.

In assembling, opposite axial close winding portions of a coil spring 23 are received in the large-diameter portions of the bolt holes 18, 19 oppositely disposed from each other. A central portion of the coil spring 23 forms a coarse winding portion as is clear from FIG. 3. The central shoulder portions 20, 21 of the bolts holes 18, 19 serve as spring supports for receiving the coil springs 23.

After the coil spring 23 is mounted in the large-diameter portions of the bolt holes 18, 19, an upper mounting bolt 24 and the lower mounting bolt 25 are threadably connected with the small-diameter threaded portions of the bolt holes 18, 19 through washers 26, respectively, whereby the upper disk member 1 is movably connected with the lower disk member 2 through the second embodiment of the shock absorbing means of the present invention, which embodiment is constructed of the upper mounting bolts 24, washers 26, coil springs 23 and the lower mounting bolts 25 which are assembled in a manner as shown in FIG. 4.

Each of threaded portions of the mounting bolts 24, 25 has the substantially same axial length as that of each of the bolt holes 18, 19, and is threadably connected with each of the small-diameter threaded portions of the bolt holes 18, 19 and each of the opposite close winding portions of the coil springs 23 in assembling, to make it possible that the upper disk member 1 is movably connected with the lower disk member 2 through the coil springs 23. As is clear from FIG. 3, each of the washers 26 is interposed: between an upper surface of the upper disk member 1 and the head portion of each of the upper mounting bolts 24; and between the lower surface of the lower disk member 2 and the head portion of each of the lower mounting bolts 25.

Figure 5:
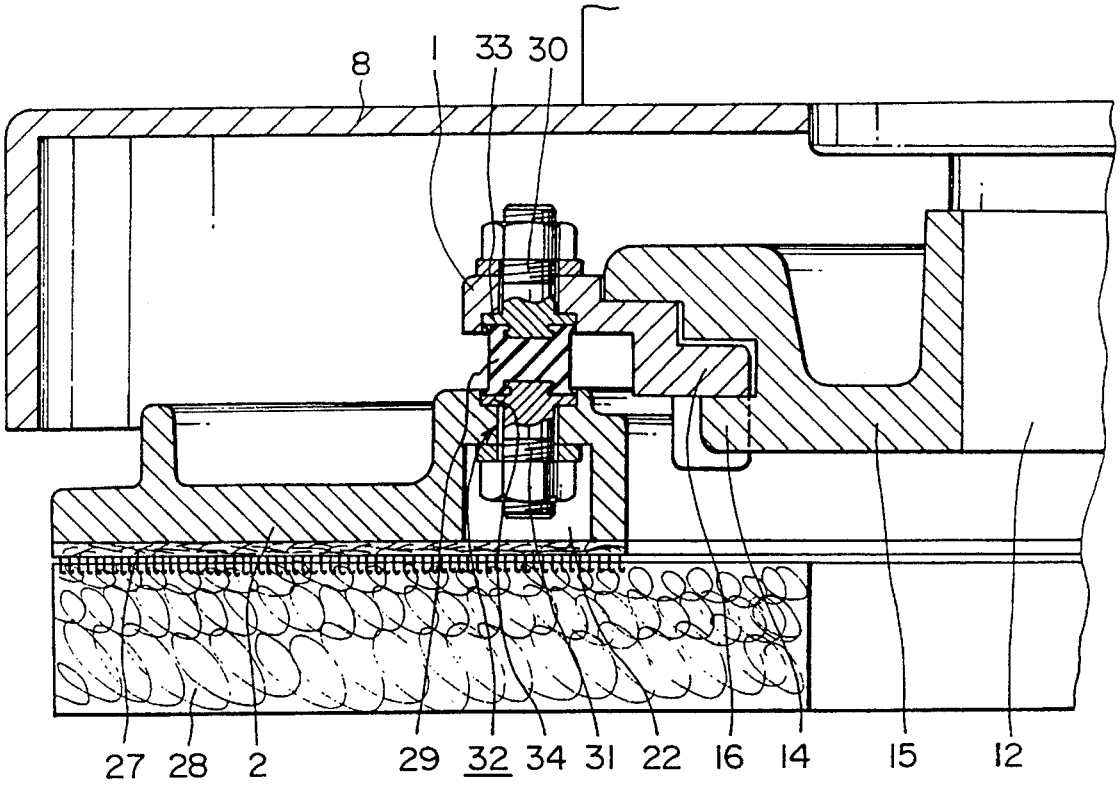
FIG. 5 is a enlarged side view of an essential part of the rotary brush floor polisher employing a third embodiment of the shock absorbing means of the present invention.
Figure 6:
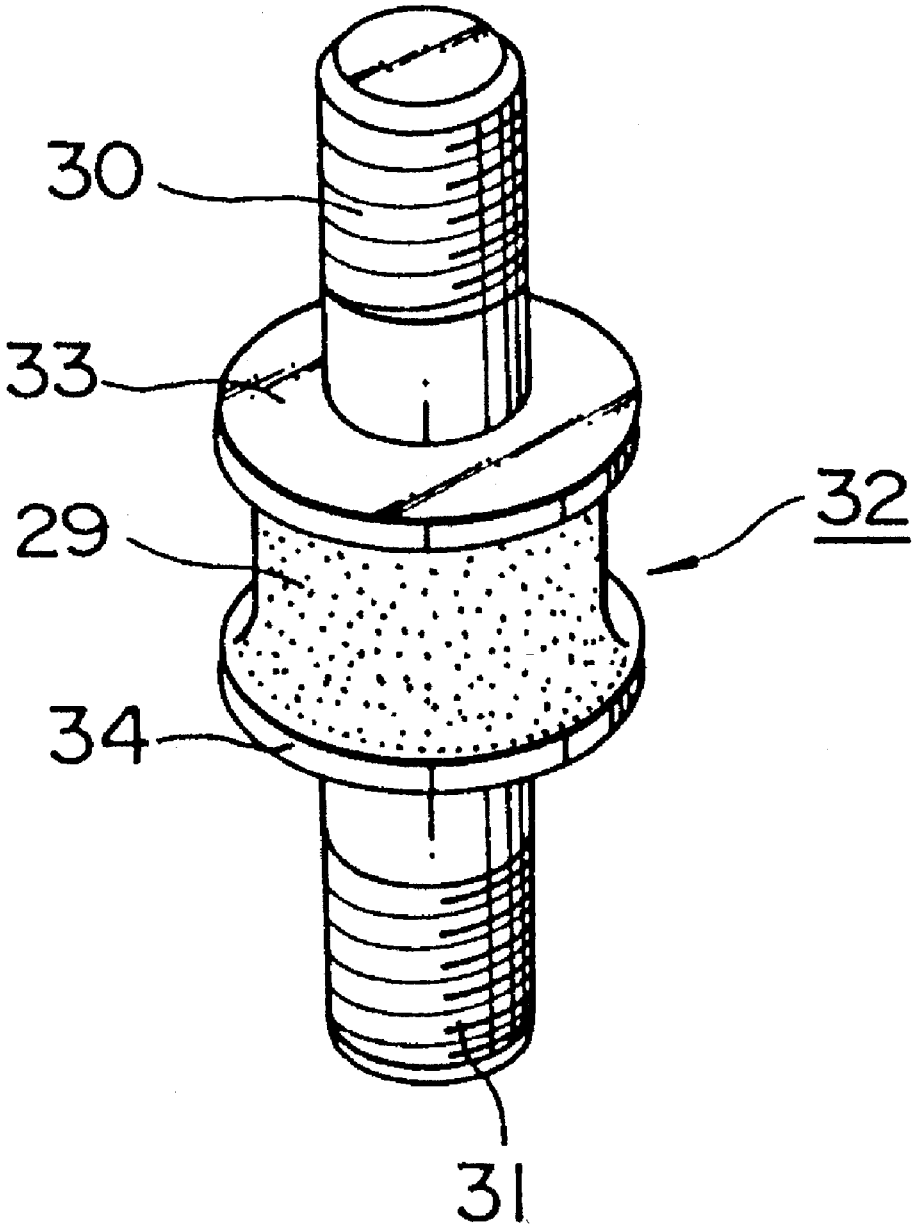
FIG. 6 is a perspective view of the third embodiment of the shock absorbing means of the present invention shown in FIG. 5.

FIGS. 5 and 6 show a third embodiment of the shock absorbing means employed in the rotary brush floor polisher of the present invention. As shown in FIG. 6, the third embodiment 32 of the shock absorbing means of the present invention is constructed of: a solid cylindrical rubber vibration insulator 29; an upper stud bolt 30 which has its head portion embedded in an upper axial end portion of the insulator 29 to permit its threaded portion to axially extend upward from the upper axial end portion of the insulator 29; a lower stud bolt 31 which has its head portion embedded in a lower axial end portion of the insulator 29 to permit its threaded portion to axially extend downward from the lower axial end portion of the insulator 29. In addition, a pair of mounting plates 33, 34 are fixedly mounted on the opposite axial end portions of the insulator 29 through baking process. In assembling, the third embodiment or shock absorbing member 32 of the present invention is interposed between the upper disk member 1 and the lower disk member 2. Namely, each of the threaded portions of the upper stud bolts 30 of the shock absorbing member 32 are inserted into each of mounting bolt holes of the upper disk member 1, which bolt holes are formed in an outer peripheral portion of the upper disk member 1 at equal angular intervals. On the other hand, each of the threaded portions of the lower stud bolts 31 of the shock absorbing member 32 are inserted into each of mounting bolt holes of the lower disk member 2, which bolt holes are formed in an inner peripheral portion or boss portion 17 of the lower disk member 2 at equal angular intervals. After that, the threaded portions of the stud bolts 30, 31 are threadably connected with nuts through washers so that the upper disk member 1 is movably connected with the lower disk member 2 through the shock absorbing members 32.

In the above embodiments of the shock absorbing means employed in the rotary brush floor polisher of the present invention, the coil springs 23 or the rubber vibration insulators 29, 48 absorb vibrations in operation of the floor polisher, to make it possible to reduce noise and ensure a safety operation. Since the above embodiments of the shock absorbing means of the present invention are not bulky, it is possible for the floor polisher of the present invention to realize reduction in size.

In addition, any of the above embodiments of the shock absorbing means of the present invention may be interposed: between the upper disk member 1 and the lower disk member 2; and between the electric motor 11 and the platform 8 to reduce vibrations in operation.

Figure 7:
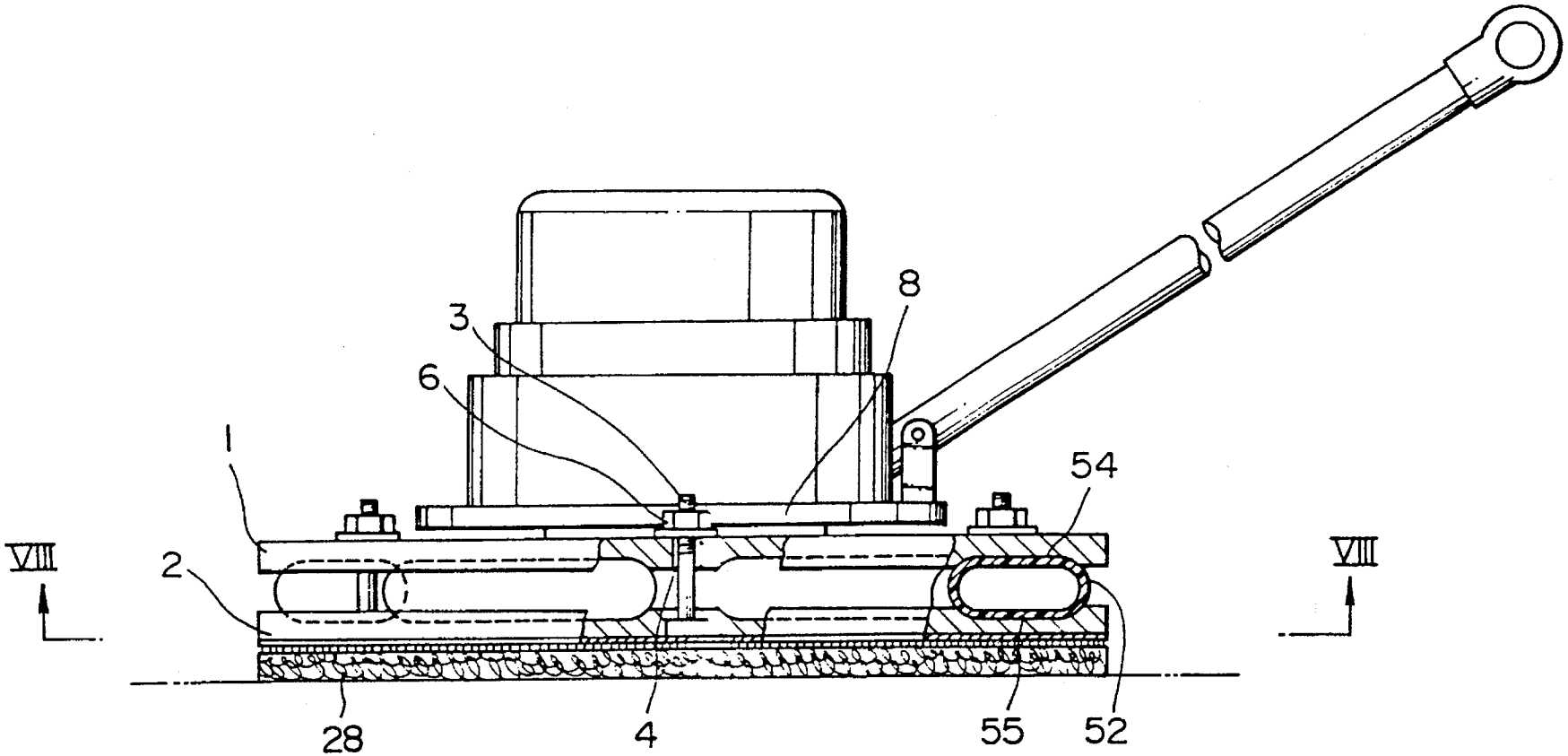
FIG. 7 is a side view of a fourth embodiment of the shock absorbing means employed in the rotary brush floor polisher of the present invention.
Figure 8:
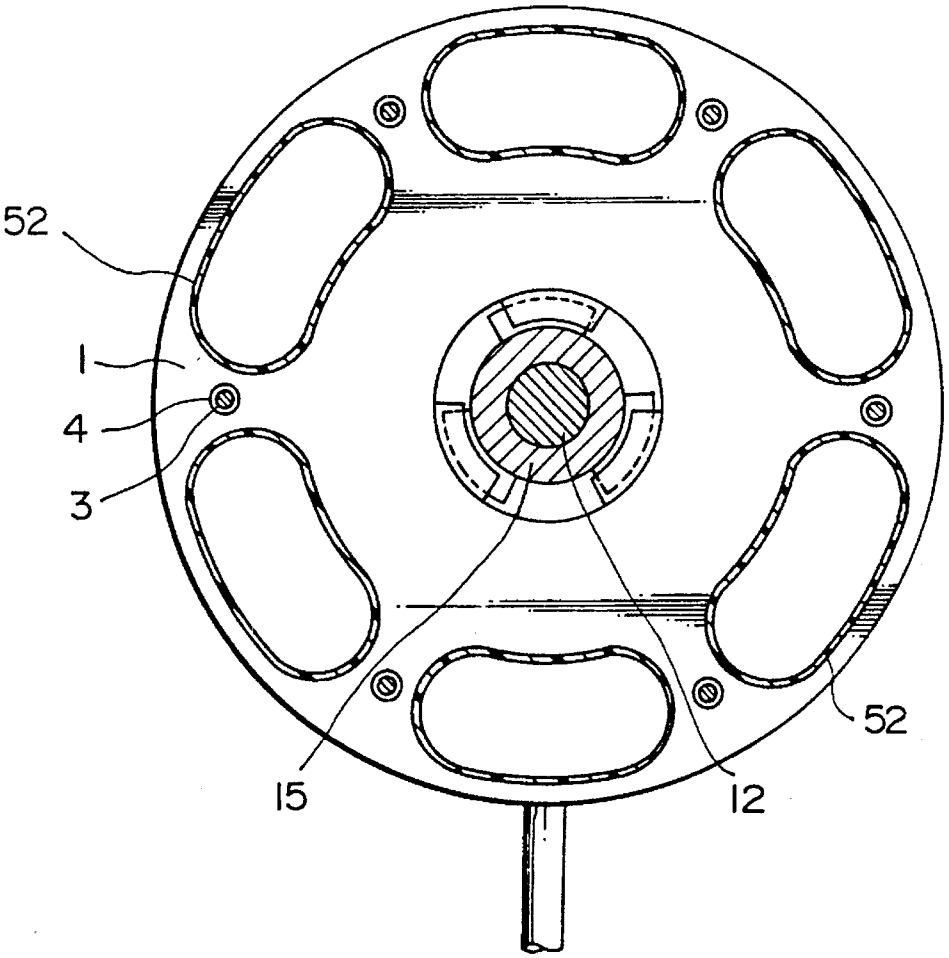
FIG. 8 is a cross-sectional view of the rotary brush floor polisher of the present invention, taken along the line VIII—VIII of FIG. 7.
Figure 9:
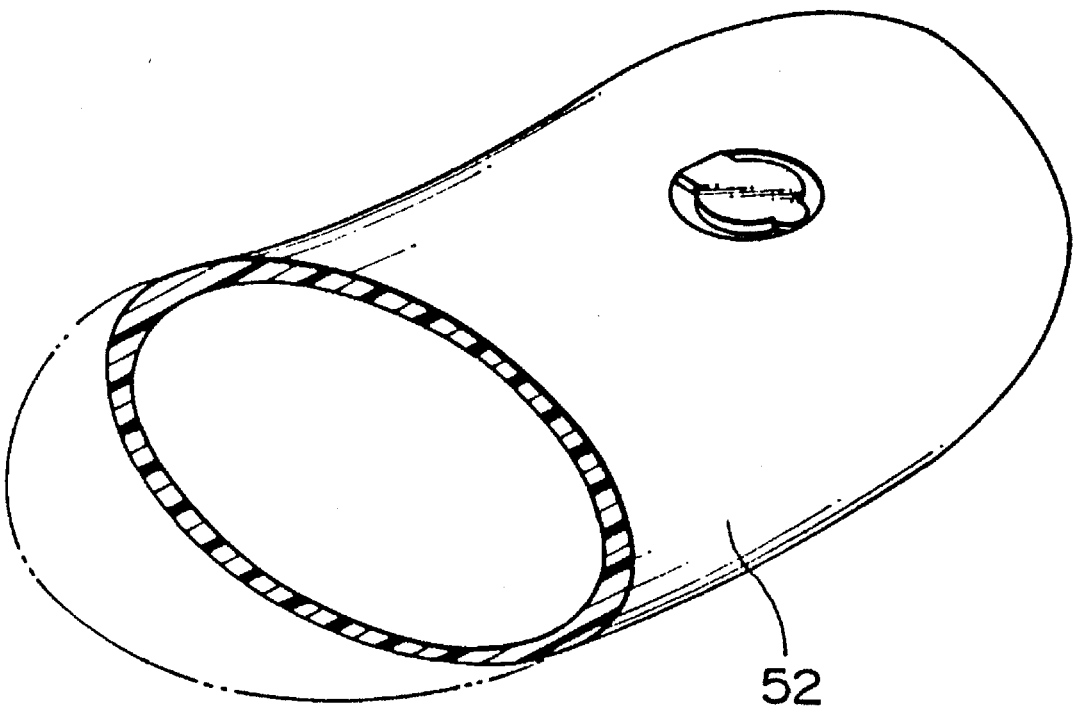
FIG. 9 is a partially broken perspective view of the fourth embodiment of the shock absorbing means of the present invention, which means assumes a pneumatic bag form.

FIGS. 7 to 9 show a fourth embodiment of the shock absorbing means employed in the rotary brush floor polisher of the present invention, which fourth embodiment is constructed of a plurality of pneumatic bags 52 sandwiched between the upper disk member 1 and the lower disk member 2. As is clear from FIG. 7, in the fourth embodiment of the shock absorbing means of the present invention, the upper disk member 1 has the substantially same diameter as that of the lower disk member 2.

As shown in FIG. 7, the upper disk member 1 is provided with a plurality of bolt holes 4 in each of which is movably received a mounting bolt 3 which is slightly smaller in diameter than each of the bolt holes 4 to make it possible that the upper disk member 1 having been connected with the lower disk member 2 by means of the mounting bolts 3 is movable relative to the lower disk member 2.

Each of the pneumatic bags 52 may be filled with air while made of any material, and may assume any shape. In the fourth embodiment of the shock absorbing means shown in FIG. 8, the plurality of the pneumatic bags 52 are concentrically arranged. However, it is also possible to employ a single annular pneumatic bag in place of the plurality of the pneumatic bags 52, in which single annular pneumatic bag a plurality of through-holes are formed at equal angular intervals to enable the mounting bolts 3 to pass through such single pneumatic bag in assembling.

The pneumatic bags 52 may be filled with any suitable fluid such as gases and liquids.

Figure 10:
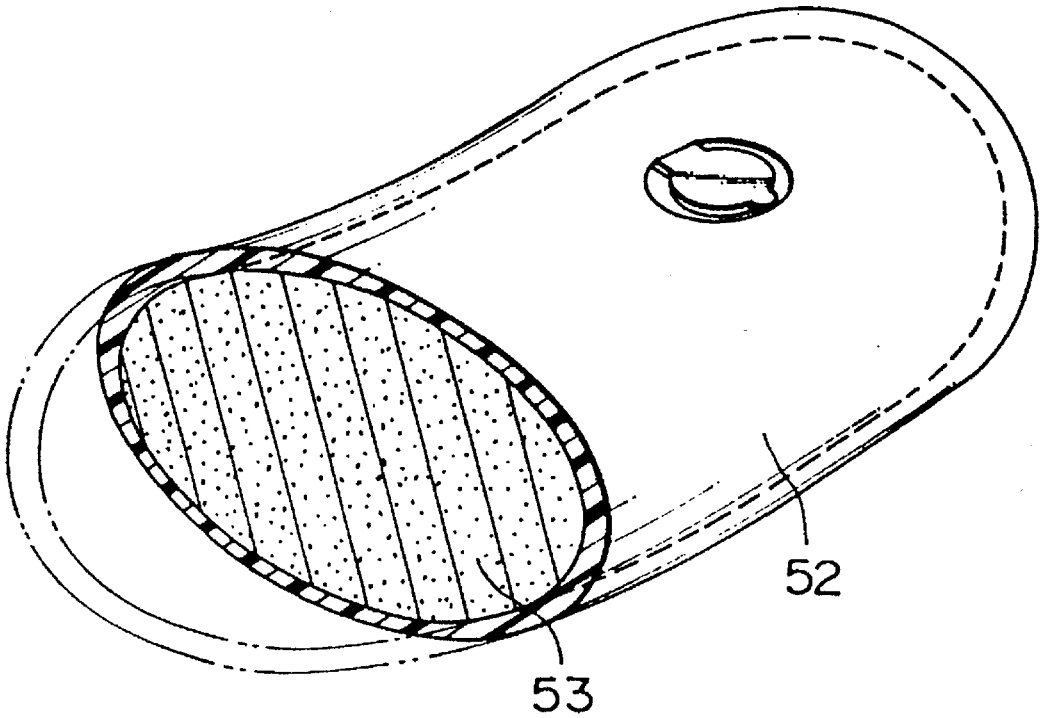
FIG. 10 is a partially broken perspective view of a fifth embodiment of the shock absorbing means of the present invention, which means assumes a bag form filled with elastic porous materials.
Figure 11:
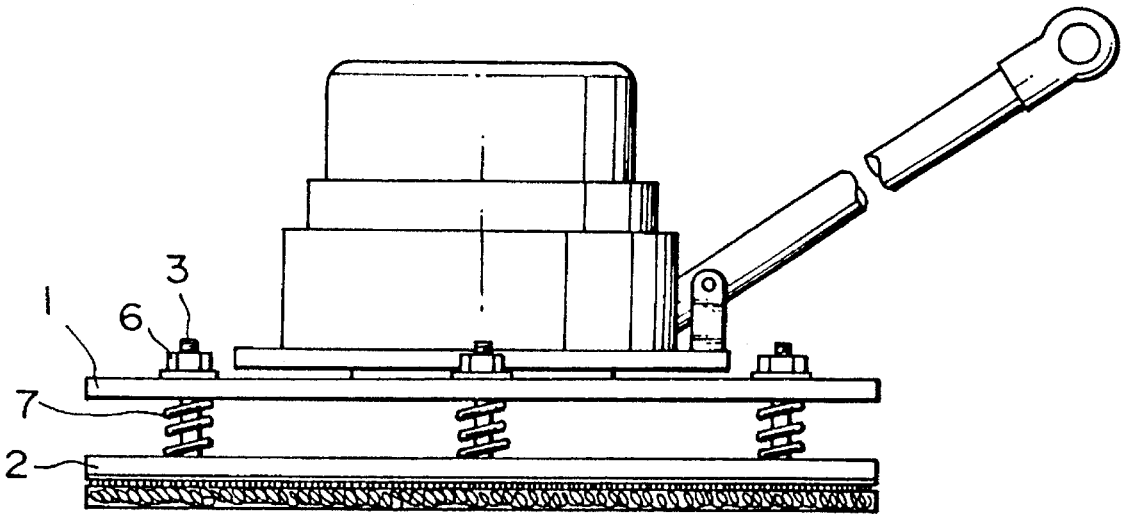
FIG. 11 (PRIOR ART)
FIG. 11 is a side view of the conventional rotary brush floor polisher.
Figure 12:
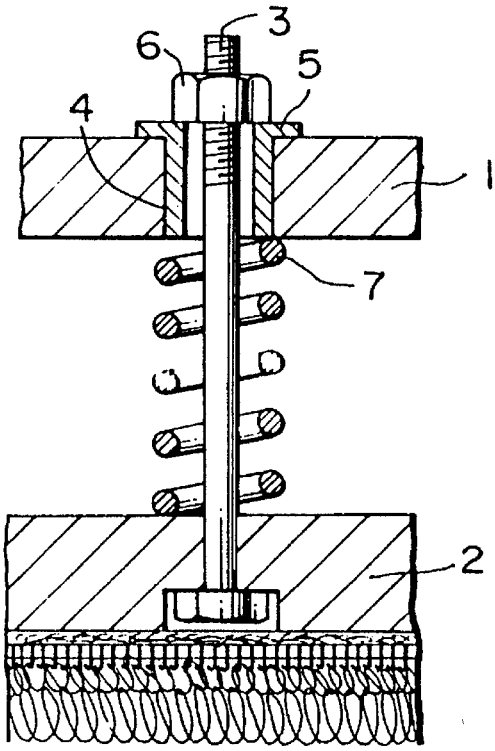
FIG. 12 (PRIOR ART)
FIG. 12 is an enlarged sectional view of an essential part of the conventional rotary floor polisher shown in FIG. 11.

In addition, as shown in FIG. 10, the pneumatic bags 52 may be filled with elastic porous material 53 in place of air.

As is clear from FIG. 7, a plurality of concave portions 54 are formed in a lower surface of the upper disk member 1 at equal angular intervals to receive upper portions of the pneumatic bags 52 therein. On the other hand, a plurality of concave portions 55 are formed in an upper surface of the lower disk member 2 at equal angular intervals in positions corresponding to those of the concave portions of the upper disk member 1 to receive lower portions of the pneumatic bags 52 therein, whereby the pneumatic bags 52 are steady held between the upper disk member 1 and the lower disk member 2. These concave portions 54, 55 may be replaced with suitable projections and like means formed in each of the upper disk member 1 and the lower disk member 2.

What is claimed is:

1. A rotary brush floor polisher, comprising:

a platform having a lower surface and an operating handle;

an electric motor having a downwardly extending rotary shaft, and a first shock absorbing means for fixedly mounting said electric motor on said platform such that said rotary shaft extends downwardly from said lower surface of said platform;

an upper disk member which extends coaxially about said rotary shaft, said upper disk member being disposed under said lower surface of said platform;

means for connecting said rotary shaft of said electric motor to said upper disk member;

a lower disk member which is disposed under said upper disk member and extends coaxially about said rotary shaft, said lower disk member extending further in an outwardly radial direction than does said upper disk member, said lower disk having an annular inner peripheral surface which is coaxial about said rotary shaft of said electric motor;

a second shock absorbing means for connecting said lower disk member to said upper disk member such that said lower disk member is movable in vertical and horizontal directions relative to said upper disk member; and a brush or pad fixedly mounted on a lower surface of said lower disk member.

2. The rotary brush floor polisher as set forth in claim 1, wherein:

said second shock absorbing means is constructed of a pair of mounting bolts and a shock-absorbing coil spring which has its opposite axial end portions closely wound and its central portion coarsely wound;

one of said mounting bolts is so mounted in a through-hole of said upper disk member as to have its threaded portion extend downward from a lower surface of said upper disk member;

the other of said mounting bolts is so mounted in a through-hole of the lower disk member as to have its threaded portion extend upward from an upper surface of said lower disk member, while aligned with said one of said mounting bolts in position so as to be oppositely disposed from the same; and said shock-absorbing coil spring is so mounted on said threaded portions of the thus aligned mounting bolts as to have its opposite axial end portions threadably connected with said threaded portions of said mounting bolts, so that said upper and lower disk member are movably connected with each other by means of said mounting bolts and said shock-absorbing coil spring.

3. The rotary brush floor polisher as set forth in claim 1, wherein:

each of said first and second shock absorbing means includes a solid cylindrical rubber vibration insulator and a pair of mounting bolt head portions which are embedded in opposite axial end portions of said cylindrical rubber vibration insulator; each of said mounting bolts having threaded portions which are embedded in said insulator and which respectively pass through a through-hole of each of said upper and said lower disk members and is in threaded connection with a nut, so that said upper and said lower disk members are movably connected with each other by means of said second shock absorbing means.

4. The rotary brush floor polisher as set forth in claim 1, wherein:

each of said first and second shock absorbing means includes an annular rubber vibration insulator and a pair of annular mounting plates sandwiching said annular rubber vibration insulator which are fixedly mounted on an upper and a lower surface of said annular rubber vibration insulator.

5. The rotary brush floor polisher as set forth in claim 1, wherein each of said first and second shock absorbing means includes a sleeve-like rubber vibration insulator having inner and an outer peripheral surfaces, and an inner metallic mounting sleeve and an outer metallic mounting sleeve which are respectively fixedly mounted on said inner and outer peripheral surfaces of said sleeve-like rubber vibration insulator through a baking process; and a mounting bolt passing through said sleeve-like rubber vibration insulator.

6. The rotary brush floor polisher as set forth in claim 1, wherein:

said second shock absorbing means includes a bag filled with a fluid; wherein said second shock absorbing means includes a pair of mounting bolt head portions which are connected to opposite axial end portions of said bag; each of said mounting bolts having threaded portions which respectively pass through a through-hole of each of said upper and said lower disk members and is in threaded connection with a nut, so that said upper and said lower disk members are movably connected with each other by means of said second shock absorbing means.

7. The rotary brush floor polisher as set forth in claim 6, wherein:

said fluid is gaseous material.

8. The rotary brush floor polisher as set forth in claim 6, wherein:

said fluid is liquid.

9. The rotary brush floor polisher as set forth in claim 6, wherein:

said bag is filled with elastic porous material.

10. A rotary brush floor polisher as set forth in claim 1, wherein said second shock absorbing means comprises a resilient member, and said upper disk member includes a bayonet socket portion which is connected to a bayonet fitting attached to said rotary shaft; wherein said second shock absorbing means includes a pair of mounting bolt head portions which are connected to opposite axial end portions of said resilient member; each of said mounting bolts having threaded portions which respectively pass through a through-hole of each of said upper and said lower disk members and is in threaded connection with a nut, so that said upper and said lower disk members are movably connected with each other by means of said second shock absorbing means.

11. A rotary brush floor polisher as set forth in claim 10, wherein said resilient member comprises a solid cylindrical resilient member having an upper one of said mounting bolts extending therefrom for connection of said bayonet socket portion to said upper disk member.

12. A rotary brush floor polisher as set forth in claim 11, wherein said resilient member further comprises a lower one of said mounting bolts extending therefrom and which is received in said lower disk member, for connection of said lower disk member to said resilient member.

13. A rotary brush floor polisher as set forth in claim 10, wherein said resilient member comprises a solid cylindrical resilient member having an upper stud bolt extending from a first side of said solid cylindrical resilient member, for connection of said bayonet socket portion to said upper disk member; and a lower stud bolt extending from a second, opposite side of said solid cylindrical resilient member; and wherein said upper and lower stud bolts each have respective mounting surfaces extending radially therefrom abutting said first and second surfaces of said solid cylindrical resilient member, respectively, and an enlarged headed portion extending into said solid cylindrical resilient member so as to be retained by said solid cylindrical resilient member second.

14. A rotary brush floor polisher as set forth in claim 1, wherein said second shock absorbing means comprises a resilient member, and said upper disk member includes a bayonet socket portion which is connected to a bayonet fitting attached to said rotary shaft, and wherein said bayonet socket portion extends radially inwardly from said upper disk member.

* * * * *